US005954491A

United States Patent [19]

Helton et al.

[11] Patent Number: 5,954,491

[45] Date of Patent: Sep. 21, 1999

[54] WIRE LOCK SHIELD FACE FOR BURNER NOZZLE

[75] Inventors: Woodward Clinton Helton; Daniel Isaiah Saxon; Stacey Elaine Swisher; Gary Scott Whittaker, all of Kingsport, Tenn.

[73] Assignee: Eastman Chemical Company, Kingsport, Tenn.

[21] Appl. No.: 08/833,454

[22] Filed: Apr. 7, 1997

[51] Int. Cl.[6] ..... F23D 11/00; F23C 7/00; B05B 15/00; B05B 1/28

[52] U.S. Cl. ..... 431/159; 431/187; 431/154; 431/160; 239/288.5; 239/132.3

[58] Field of Search ..... 431/159, 187, 431/160, 154; 239/103, 132, 132.3, 288, 288.3, 397.5, 288.5, 600, DIG. 19; 285/200, 401, 402, 403, 404, 414, 415, 901; 362/437

[56] References Cited

U.S. PATENT DOCUMENTS

| | | | |
|---|---|---|---|
| 643,200 | 2/1900 | Rankert | 285/404 |
| 1,187,321 | 6/1916 | Hubbard | 285/901 |
| 2,809,104 | 10/1957 | Strasser et al. | 48/215 |
| 2,827,914 | 3/1958 | Alters | 137/371 |
| 2,928,459 | 3/1960 | Eastman et al. | 431/159 |
| 3,375,090 | 3/1968 | Marra, Jr. | 431/159 |
| 3,504,856 | 4/1970 | Hinkeldey, Jr. et al. | 239/132.3 |
| 4,502,633 | 3/1985 | Saxon | 239/132.3 |
| 5,273,212 | 12/1993 | Gerhardus et al. | 239/132.3 |

*Primary Examiner*—Ira S. Lazarus
*Assistant Examiner*—David Lee
*Attorney, Agent, or Firm*—Harry J. Givinnell; Matthew W. Smith; Susan F. Wagner

[57] ABSTRACT

The water jacket face of a burner nozzle for a synthesis gas generator is protected from hot gas corrosion by an annular heat shield of high temperature melting point material. The heat shield element is secured to the water jacket face by means of six, for example, radially aligned bayonet mounts. Along each of the radial mounting lines, a pair of radially aligned posts project from the water jacket face. Blind sockets in the heat shield back side surface are aligned to receive the posts therein. Radial bayonet channels between the heat shield face side and backside surfaces connect the inner outer heat shield perimeters through the posts and post sockets. Bayonet wires through the bayonet channels secure the heat shield position relative to the water jacket face.

19 Claims, 6 Drawing Sheets

WIRE LOCK SHIELD FACE FOR BURNER NOZZLE

BACKGROUND OF THE INVENTION

The present invention relates to apparatus for practicing a partial oxidation process of synthesis gas generation. In particular, the present invention is applicable to the generation of carbon monoxide, carbon dioxide, hydrogen and other gases by the partial combustion of a particulate hydrocarbon such as coal in the presence of water and oxygen.

Synthesis gas mixtures essentially comprising carbon monoxide and hydrogen are important commercially as a source of hydrogen for hydrogenation reactions and as a source of feed gas for the synthesis of hydrocarbons, oxygen-containing organic compounds or ammonia.

The partial combustion of a sulfur bearing hydrocarbon fuel such as coal with oxygen-enriched air or with relatively pure oxygen to produce carbon monoxide, carbon dioxide and hydrogen presents unique problems not encountered normally in the burner art. It is necessary, for example, to effect very rapid and complete mixing of the reactants, as well as to take special precautions to protect the burner or mixer from over heating.

Because of the reactivity of oxygen and sulfur contaminants with the metal from which a suitable burner may be fabricated, it is imperative to prevent the burner elements from reaching those temperatures at which rapid oxidation and corrosion takes place. In this respect, it is essential that the reaction between the hydrocarbon and oxygen take place entirely outside the burner proper and that localized concentration of combustible mixtures at or near the surfaces of the burner elements is prevented. Even though the reaction takes place beyond the point of discharge from the burner, the burner elements are subjected to heating by radiation from the combustion zone and by turbulent recirculation of the burning gases.

For these and other reasons, prior art burners are characterized by failures due to metal corrosion about the burner tips: even when these elements have been water cooled and where the reactants have been premixed and ejected from the burner at rates of flow in excess of the rate of flame propagation.

It is therefore an object of the present invention to provide a novel burner for synthesis gas generation which is an improvement over the shortcomings of prior art appliances, is simple in construction and economical in operation.

Another object of the invention is to provide a synthesis gas generation burner nozzle having a greater operational life expectancy over the prior art.

Another object of the present invention is to provide a gas generation burner nozzle for synthesis gas generation having a reduced rate of corrosion.

A further object of the present invention is the provision of a burner nozzle heat shield to protect metallic elements of the nozzle from corrosive combustion gases.

Also an object of the present invention is a mechanical apparatus for securing a ceramic heat shield to a burner nozzle surface.

A still further object of the present invention is a ceramic heat shield assembly to control corrosion of a burner nozzle.

SUMMARY OF THE INVENTION

These and other objects of the invention as will become apparent from the detailed description of the preferred embodiment to follow are achieved by a substantially symmetric, axial flow fuel injection nozzle serving the combustion chamber of a synthesis gas generator. The nozzle is configured to have an annular slurried fuel stream that concentrically surrounds a first oxidizer gas stream along the axial core of the nozzle.

A second oxidizer gas stream surrounds the fuel stream annulus as a larger, substantially concentric annulus.

The fuel stream comprises a pumpable slurry of water mixed with finely particulated coal. The oxidizer gas contains substantial quantities of free oxygen for support of a combustion reaction with the coal.

A hot gas stream is produced in the refractory-lined combustion chamber at a temperature in the range of about 700° C. to about 2500° C. and at a pressure in the range of about 1 to about 300 atmospheres and more particularly, about 10 to about 100 atmospheres. The effluent raw gas stream from the gas generator comprises hydrogen, carbon monoxide, carbon dioxide and at least one material selected from the group consisting of methane, hydrogen sulfide and nitrogen depending on the fuel and reaction conditions.

Radially surrounding an outer wall of the outer oxidizer gas channel is an annular cooling water jacket terminated with a substantially flat end-face heat sink aligned in a plane substantially perpendicular to the nozzle discharge axis. Cool water is conducted from outside the combustion chamber into direct contact with the backside of the heat sink end-face for conductive heat extraction.

Combustion reaction components comprising the fuel and oxidizer are sprayed under significant pressure of about 80 bar into the combustion chamber of the synthesis gas generator. A torroidial circulation pattern within the combustion chamber carries hot gas along an axially central course out from the nozzle face. Distally from the nozzle face, the gases begin to cool and spread radially outward toward the chamber walls. While most of the combustion product and resulting synthesis gas is drawn from the combustion chamber into a quench vessel, some of the synthesis gas recirculates against the combustion chamber walls toward the nozzle end of the chamber.

The confluence of the recirculated gas flow stream with the nozzle emission stream is believed to generate a standing eddy of hot, turbulent combustion product. This eddy, comprising highly corrosive sulfur compounds, surrounds the nozzle discharge orifice in the manner of a toroid and scrubs the heat shield face at the confluence.

To protect the metallic structure of the water jacket end-face, a ceramic heat shield is mechanically secured over the water jacket end-face. This heat shield is formed as an integral ring or annulus around the nozzle orifice of material selected to tolerate temperatures in excess of 1400° C. Additionally the selected materials are resistant to a highly reducing/sulfidizing environment and provide a high coefficient of expansion.

The outer face of the heat shield is substantially smooth and uninterrupted to provide minimum contact with the reaction gases and opportunity for reactive combination.

The inner face of the heat shield that is contiguous with the water jacket end-face includes a plurality of socket pairs, each pair in radial alignment around the heat shield annulus. A bayonet channel is bored radially from the outer perimeter of the heat shield, between and parallel with the outer and inner heat shield faces, through each socket pair.

Positionally coordinated to the sockets are a corresponding number of mounting studs secured to the water jacket end-face and projecting normally therefrom. Each stud is bored with an aperture that aligns axially with respective bayonet channel bores.

With the heat shield in position against the water jacket end-face and the end-face studs penetrating the heat shield sockets, bayonet wires are inserted along the radial channel bore to deadbolt the heat shield to the water jacket-end face at multiple attachment points.

BRIEF DESCRIPTION OF THE DRAWINGS

Further objects and characteristics of the invention will be understood from the following description of the preferred embodiment taken in connection with the drawings wherein.

DESCRIPTION OF THE PREFERRED EMBODIMENT

Figure 1:
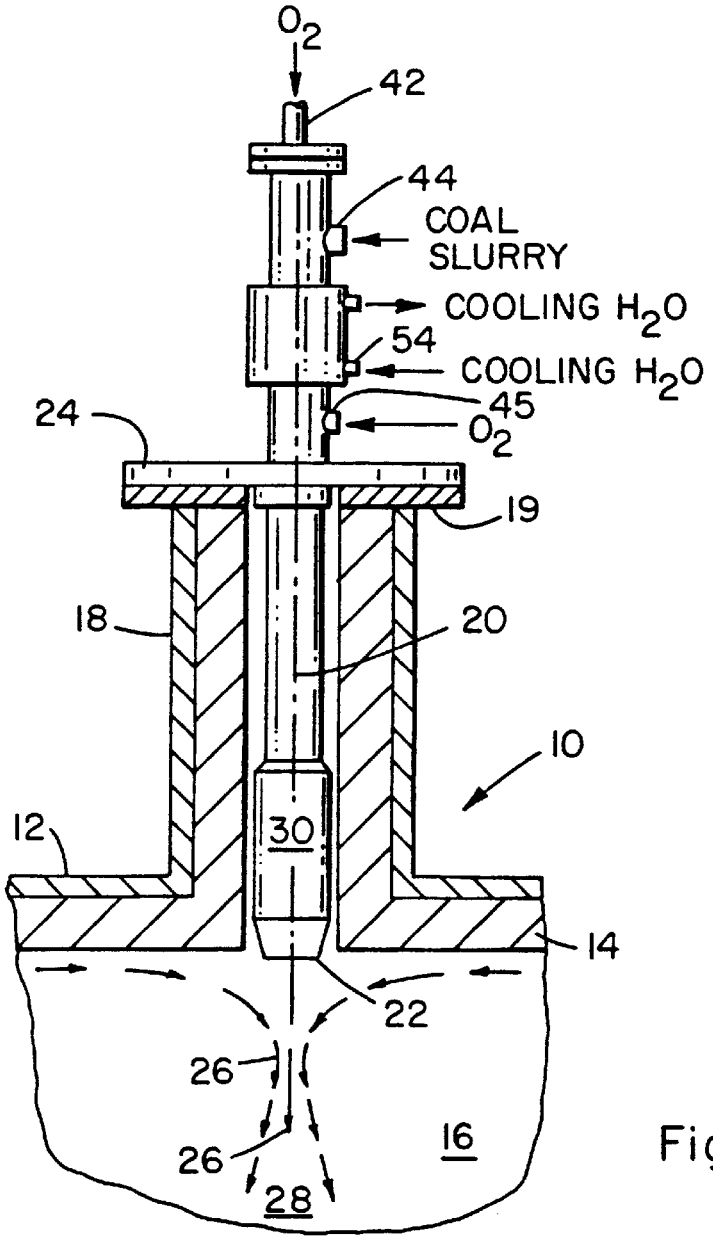
FIG. 1 is a partial sectional view of a synthesis gas generation combustion chamber and burner.

Relative to the drawings wherein like reference characters designate like or similar elements throughout the several figures of the drawing, FIG. 1 partially illustrates a synthesis gas reactor vessel 10 constructed with a structural shell 12 and an internal refractory liner 14 around an enclosed combustion chamber 16. Projecting outwardly from the shell wall is a burner mounting neck 18 for supporting an elongated fuel injection "burner" assembly 20 within the reactor vessel aligned to locate the face 22 of the burner head substantially flush with the inner surface of the refractory liner 14. A burner mounting flange 24 secured to the burner assembly 20 interfaces with a mounting neck flange 19 to secure the burner assembly 20 against the internal pressure of the combustion chamber 16.

Figure 2:
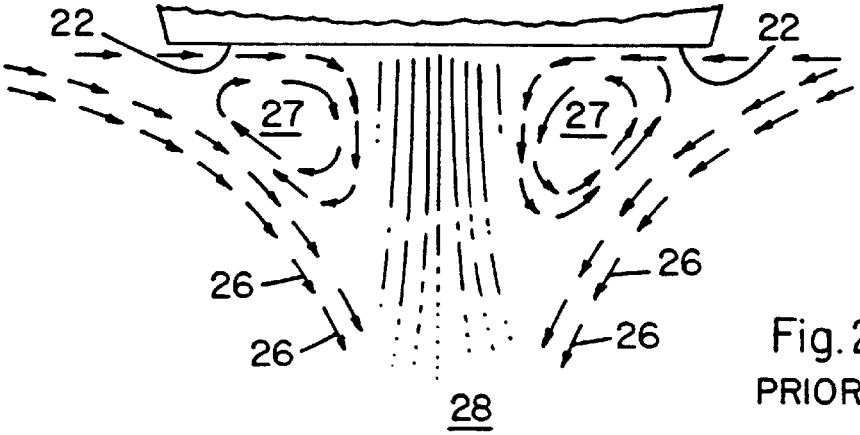
Fig. 2 PRIOR ART
FIG. 2 is a detail of the combustion chamber gas dynamics at the burner nozzle face.
Figure 3:
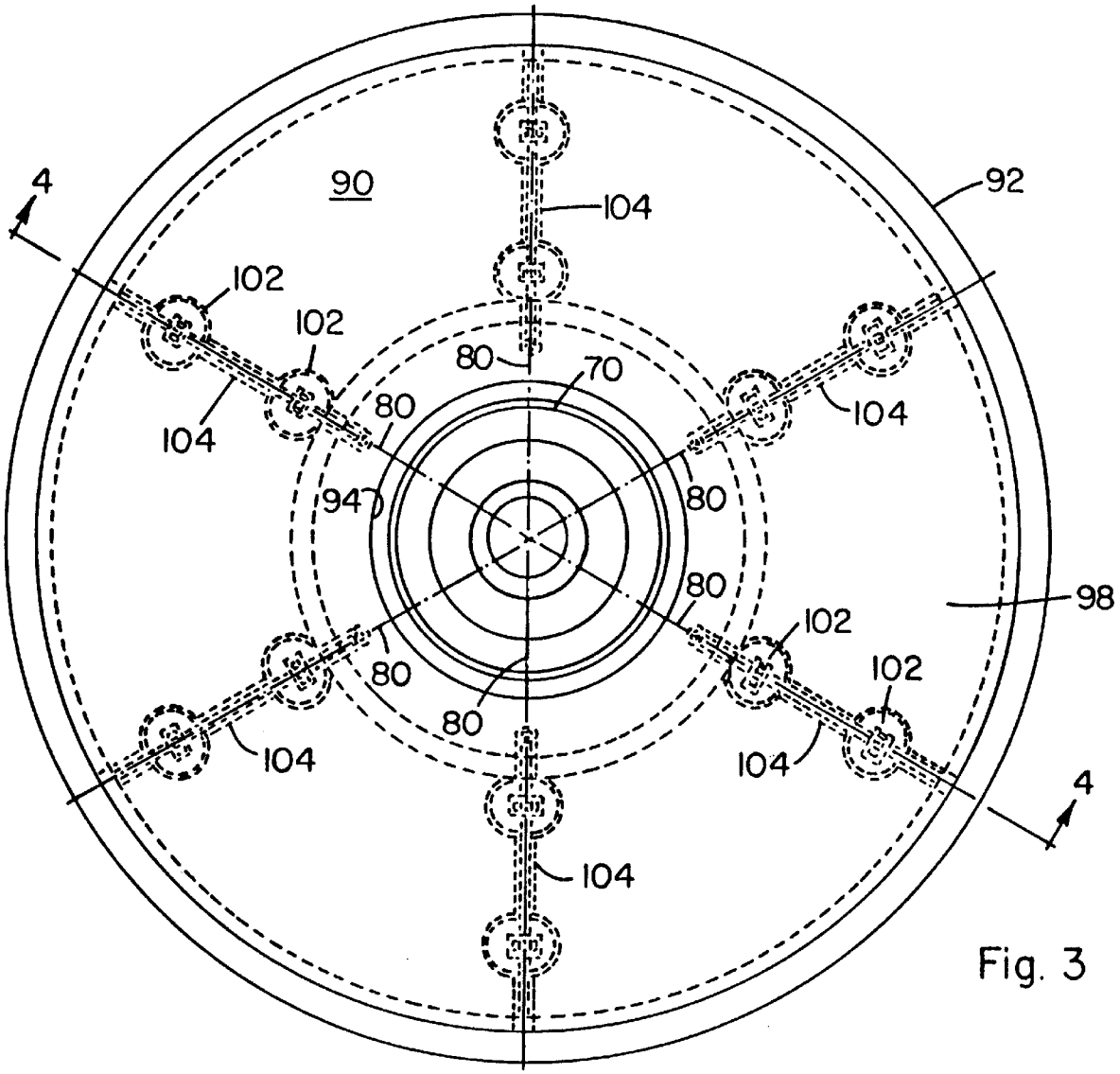
FIG. 3 is an end view of a burner nozzle discharge end.

Gas flow direction arrows 26 of FIGS. 1 and 2 partially represent the internal gas circulation pattern within the combustion chamber driven by the high temperature and high velocity reaction core 28 issuing from the nozzle assembly 30. Depending on the fuel and induced reaction rate, temperatures along the reaction core may reach as high as 2000° C. As the reaction gas cools toward the end of the chamber 16 opposite from the nozzle 30, most of the gas is drawn into a quench chamber similar to that of the synthesis gas process described by U.S. Pat. No. 2,809,104 to Dale M. Strasser et al. However, a minor percentage of the gas spreads radially from the core column 28 to cool against the reaction chamber enclosure walls. The recirculation gas layer is pushed upward to the top center of the reaction chamber where it is drawn into the turbulent down flow of the combustion column 28.

With respect to the prior art model of FIG. 2, at the confluence of the recirculation gas with the high velocity core column 28, a toroidal eddy flow 27 turbulently scrubs the burner head face 22 thereby enhancing opportunities for chemical reactivity between the burner head face material and the highly reactive, corrosive compounds carried in the combustion product recirculation stream.

One of the economic advantages of a coal fed synthesis gas process is the abundance of inexpensive, high sulfur coal which is reacted within the closed combustion chamber to release both free sulfur and hydrogen sulfide. From these sources, high value industrially pure sulfur and sulfur bearing compounds may be formed. Within the reaction chamber 16, however, such sulfur compounds tend to react with the cobalt base metal alloy materials from which the burner head face 22 is fabricated to form cobalt sulfide at extremely high temperatures. Since the cobalt fraction of this reaction is leached from the burner structure, a self-consumptive corrosion is sustained that ultimately terminates with failure of the burner assembly 20.

Although considerably cooler combustion product gases lay within the chamber 16 as a boundary layer against the refractory walls, the gases in direct, scrubbing contact with prior art burner nozzle faces tend to be extremely hot and turbulent.

Figure 4:
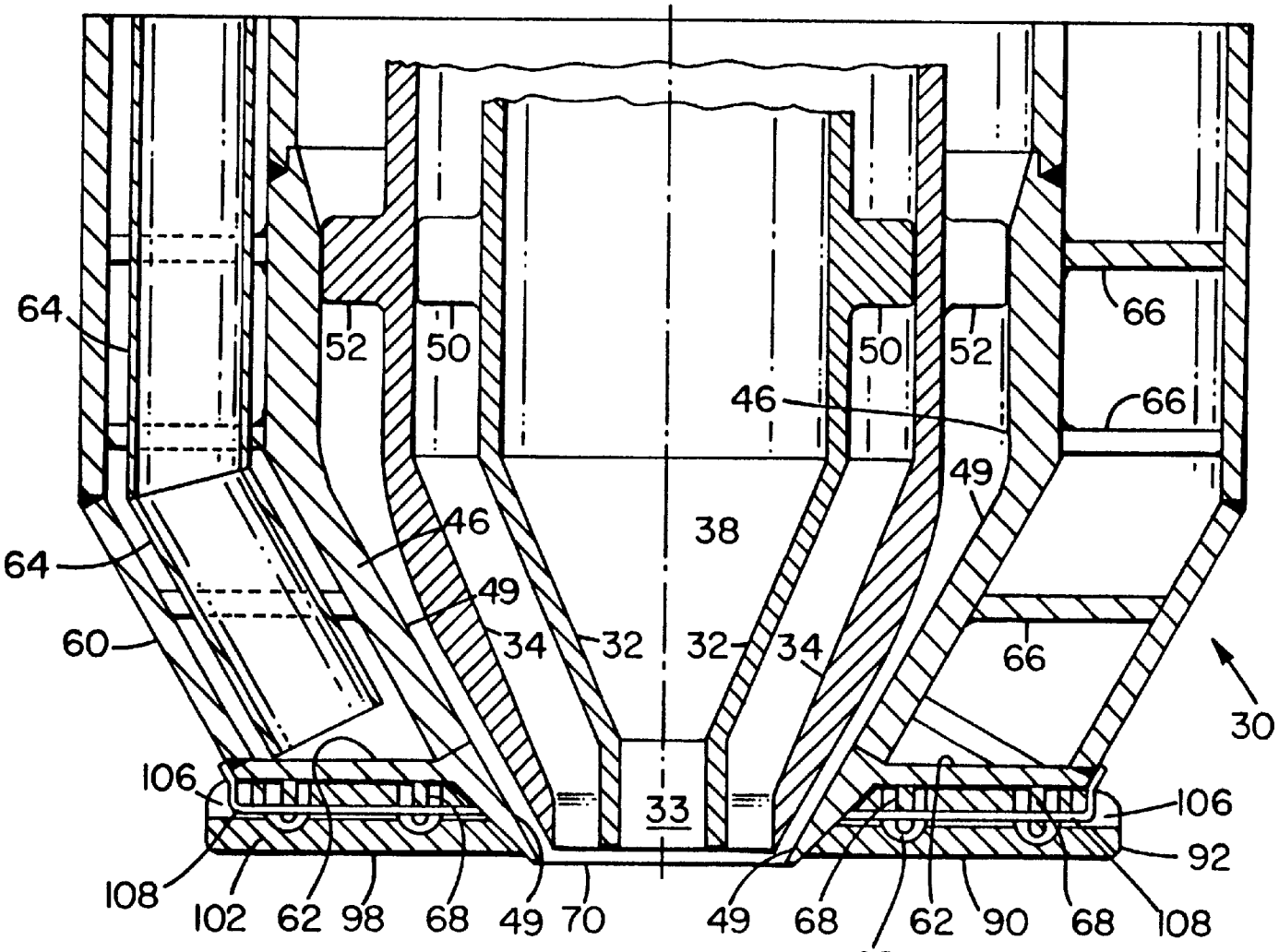
FIG. 4 is a sectioned elevation view of the invention along cutting planes 44 of FIG. 3.
Figure 9:
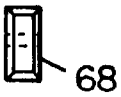
FIG. 9 is an end view of a heat shield mounting post.
Figure 8:
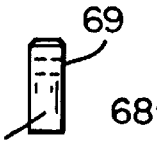
FIG. 8 is an edge view of a heat shield mounting post.
Figure 7:
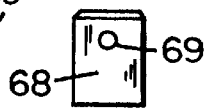
FIG. 7 is a side view of a heat shield mounting post.
Figure 5:
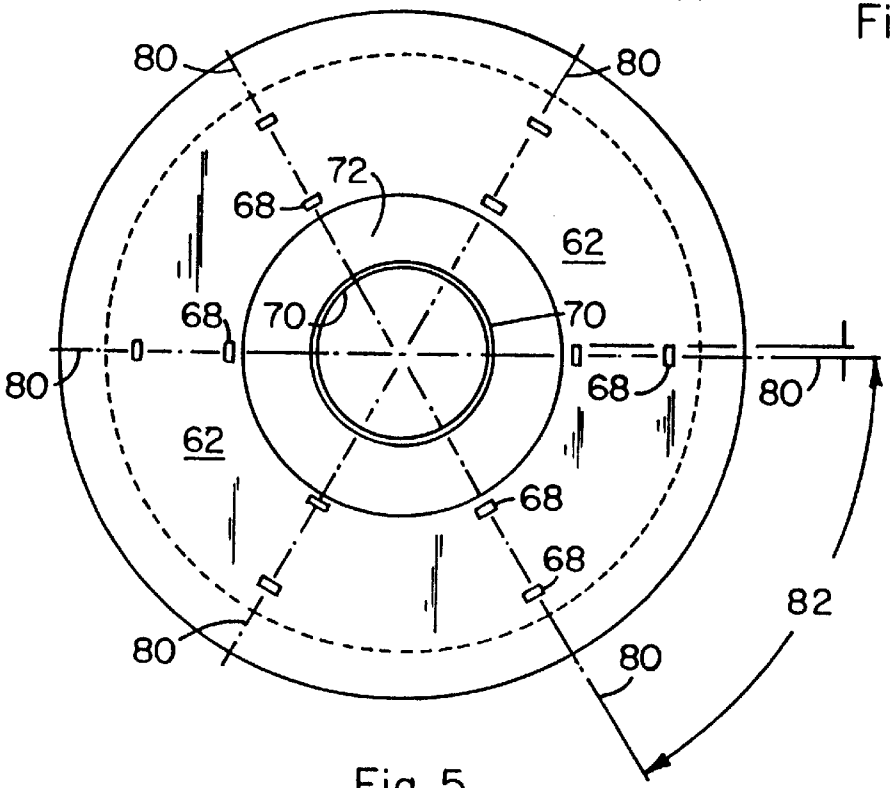
FIG. 5 is a plan view of the discharge end of a burner nozzle without a heat shield in place.
Figure 6:
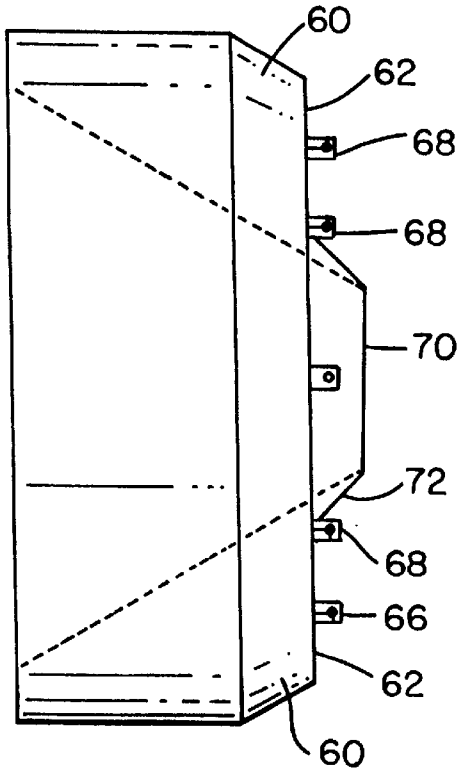
FIG. 6 is an side view of a burner nozzle without a heat shield in place.
Figure 10:
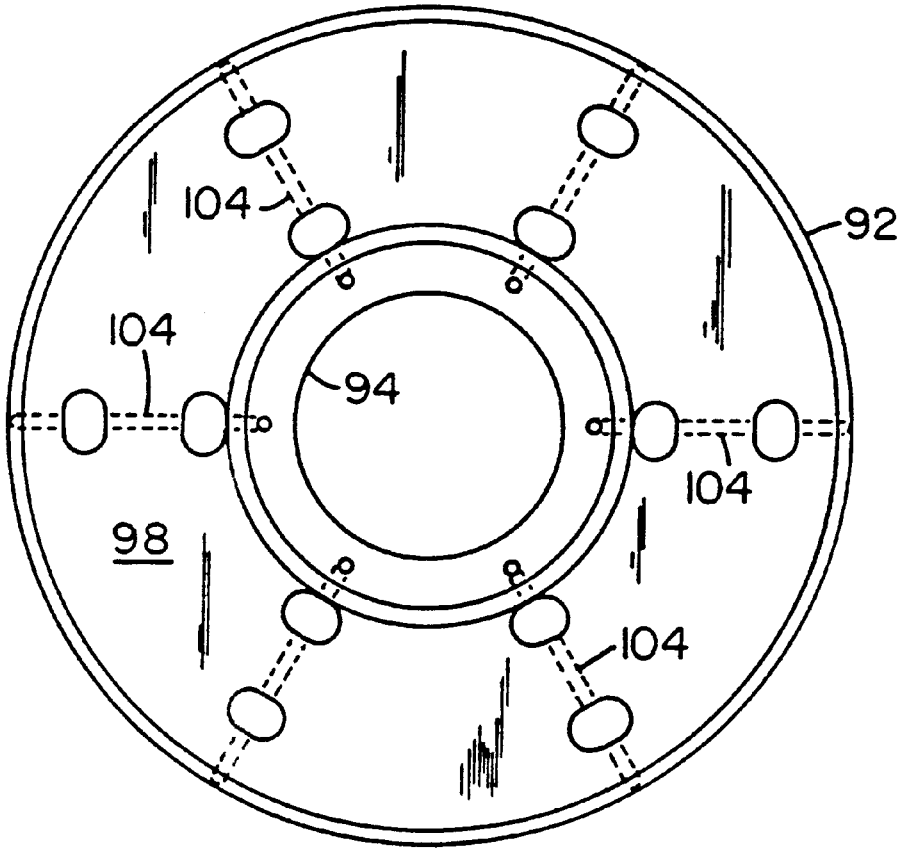
FIG. 10 is an outer surface plan view of the present heat shield.
Figure 11:
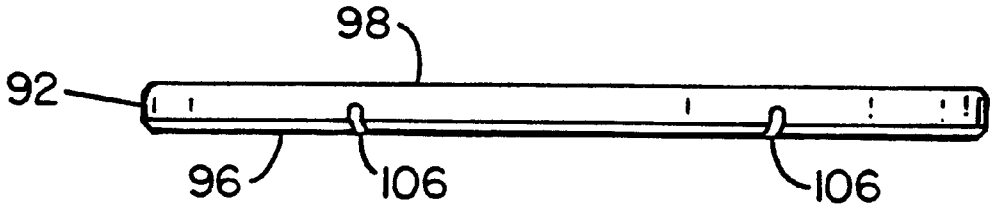
FIG. 11 is an edge view of the heat shield.
Figure 13:
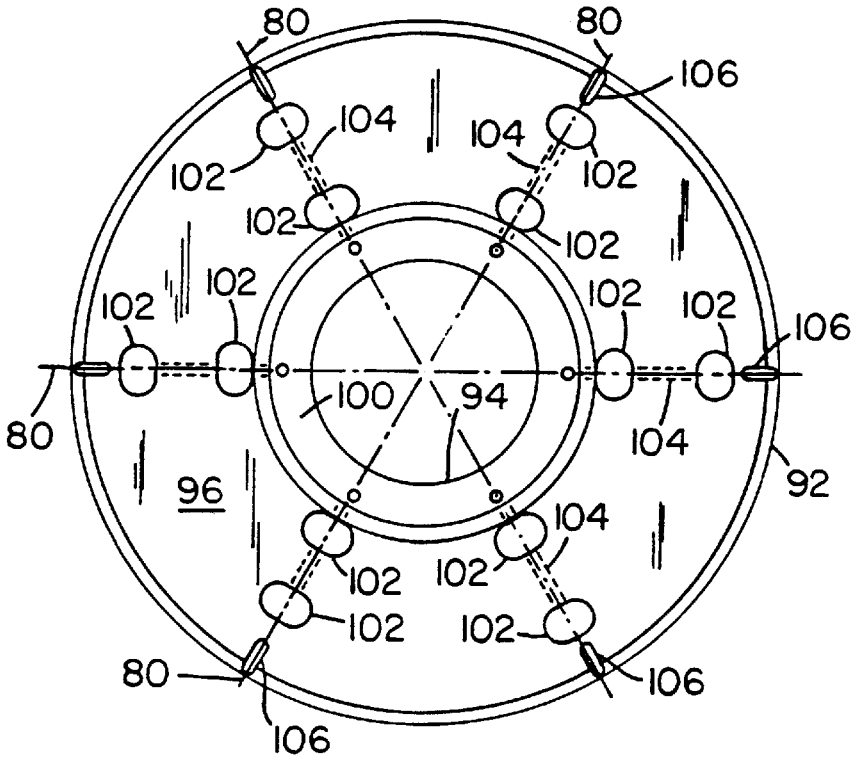
FIG. 13 is an inner surface plan view of the heat shield.
Figure 14:
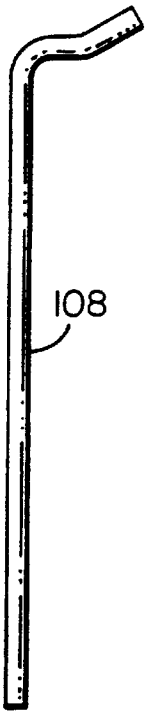
FIG. 14 is a plan view of a bayonet wire.
Figure 12:
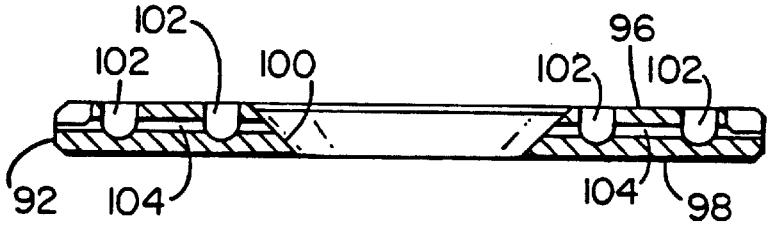
FIG. 12 is a sectional view of the heat shield.

With respect to FIG. 4, the burner assembly 20 of the present invention includes an injector nozzle assembly 30 comprising three concentric nozzle shells and an outer cooling water jacket. The internal nozzle shell 32 discharges from an axial bore opening 33 the oxidizer gas that is delivered along upper assembly axis conduit 42. Intermediate nozzle shell 34 guides the particulated coal slurry delivered to the upper assembly port 44. As a fluidized solid, this coal slurry is extruded from the annular space 36 between the inner shell wall 32 and the intermediate shell wall 34. The outer, oxidizer gas nozzle shell 46 surrounds the outer nozzle discharge annulus 48 formed between the interior surface 49 of the outer shell and the outer surface of the intermediate shell 34. The upper assembly port 45 supplies the outer nozzle discharge annulus with an additional stream of oxidizing gas.

Centralizing fins 50 radiating from the outer surface of the inner shell 32 wall bear against the interior wall of the intermediate shell 34 to keep the inner shell 33 coaxially centered relative to the intermediate shell axis. Similarly, centralizing fins 52 radiate from the intermediate shell 34 to coaxially confine it within the outer shell 46. It will be understood that the structure of the fins 50 and 52 form discontinuous bands about the inner and intermediate shells and offer small resistance to fluid flow within the respective annular spaces.

As described in greater detail by U.S. Pat. No. 4,502,633 to D. I. Saxon, the internal nozzle shell 32 and intermediate nozzle shell 34 are both axially adjustable relative to the outer nozzle shell 46 for the purpose flow capacity variation. As intermediate nozzle 34 is axially displaced from the conically tapered internal surface of outer nozzle 46, the outer discharge annulus 48 is enlarged to permit a greater oxygen gas flow. Similarly, as the outer tapered surface of the internal nozzle 32 is axially drawn toward the internally conical surface of the intermediate nozzle 34, the coal slurry discharge area 36 is reduced.

Surrounding the outer nozzle shell 46 is a coolant fluid jacket 60 having a planar end closure 62. The end closure 62 includes a nozzle lip 70 that defines an exit orifice for the reaction materials discharged by the nozzle assembly. A coolant fluid conduit 64 delivers coolant such as water from the upper assembly supply port 54 directly to the inside surface of the end closure plate 62. Flow channeling baffles 66 control the coolant flow course around the outer nozzle shell to assure substantially uniform heat extraction, prevent coolant channeling and reduce localized hot spots.

Preferably, most of the nozzle assembly 30 components are fabricated of extremely high temperature resistant material such as an R30188 metal as defined by the Unified Numbering System for Metals and Alloys. This material is a cobalt base metal that is alloyed with chrome and tungsten. Other high temperature melting point alloys such as molybdenum, tungsten or tantalum may also be used.

As an extension of the outer nozzle shell 46, a nozzle lip 70 projects from the coolant jacket end-face closure 62 with a relatively narrow angle of web thickness. For example, the outer cone surface 72 of the lip may be formed to a 45° angle with the nozzle axis 38. If the inner cone surface 49 of the lip is given a 30° angle relative to the nozzle axis 38, the web angle of the lip is only 15°.

With particular reference to FIGS. 4 through 9, studs 68 are welded to the end-face surface 62 in radially aligned pairs. Apertures 69 through the studs 68 are aligned along bayonet axes 80. The bayonet axes 80 intersect with the nozzle axis 38 at substantially uniform arc separations 82. In the preferred embodiment of six stud pairs, the arc separation between bayonet axes 80 will be about 60° each.

The heat shield element 90 is an integral ring or annulus between an outer perimeter 92 and an inner perimeter 94 having an interior face 96 and an exterior face 98. An opening 100 is provided on the interior face side of the ring about the inner perimeter 94 at an angle corresponding to the outer cone surface angle of the nozzle lip 70. Typically, the heat shield 90 may be of about 0.95 cm to about 1.27 cm thick.

Suitable materials for the heat shield should have a high temperature melting point and high coefficient of thermal expansion. Additionally, the material should have a high fracture toughness to accommodate differential thermal expansion and thermal shock and a strong resistance to a high temperature, reducing/sulfidizing environment. Meeting these characteristics are silicon nitride, silicon carbide and zirconia based ceramics such as Zirconia TZP and Zirconia ZDY which are the proprietary products of the Coors Corp. of Golden, Colo. High temperature melting point metal alloys such as molybdenum, tungsten or tantalum may also be used for the heat shield. While the exterior face of the heat shield exposed directly to the combustion chamber may reach a high of about 1400° C., the water jacket end-face should remain below about 600° C.

On the interior face of the heat shield 90 are, for example six pairs of sockets 102. Each socket pair is aligned with a bayonet axis 80 and spaced correspondingly with the studs 68 whereby all of the studs 68 may be simultaneously inserted into the sockets 102 to position the interior face 96 contiguously against the water jacket end-face surface 62.

Along each bayonet axis 80 is a bayonet channel 104 drilled approximately midway between the inner and outer faces of the heat shield. These bayonet channels are radially continuous from respective perimeter notches 106 into the nozzle lip chamber 100. The diameter of these bayonet channels 104 is coordinated to that of the L-shaped bayonet wires 108.

As will be seen from the assembly section of FIG. 4, the bayonet wires 108 are inserted along the bayonet channels 104 when the heat shield face 96 is tightly against the water jacket end-face surface 62. Such a position inserts the studs 68 within the sockets 102 to align the stud apertures 69 along the bayonet axes 80. So aligned, the bayonet wires pass through the apertures 69 to lace the heat shield 90 against the nozzle face 62.

Such mechanical interlocking may be fabricated with considerable dimensional tolerance when assembled at ambient temperature. In service, however, under high temperature stress and expansion, the relative fit may simply be reasonably tight and without high stress interferences due to thermal expansion differences.

Having described our invention in detail with particular reference to the preferred embodiment, it will be understood that variations and modifications can be implemented within the scope of the invention disclosed.

We claim:

1. A heat shielded burner nozzle for injecting a plurality of fluidized fuel and oxidizing materials into a high temperature combustion chamber, said shielded burner nozzle comprising:

an elongated outer shell having a longitudinal nozzle discharge axis and a plurality of elongated circumferentially reduced inner shells, said shells defining at least two annular channels surrounding a central channel and having upstream and downstream ends defining upstream and downstream orifices transected by said longitudinal axis, said downstream ends of said shells forming a burner head face having an outer perimeter, said downstream end of said outer shell and said outer perimeter of said burner head face defining a nozzle lip having a top, an incline, and a thickness as measured along said longitudinal axis;

a coolant jacket enveloping said outer shell and defined by an annular end-face radially extending from the top of said nozzle lip to an outermost perimeter out of which longitudinally extends a cylindrical outer wall, said annular end-face having a plurality of elongated studs protruding downstream therefrom, said studs having an aperture extending transversely therethrough and positioned below said annular end-face;

a heat shield ring having a thickness and having an inner face and an exterior face and an inner perimeter and an outer perimeter, wherein said inner perimeter defines an opening sufficient to receive said nozzle lip when said inner face is positioned adjacent to said annular end-face, said inner face having a plurality of sockets therein positioned correspondingly to the position of said studs, each of said sockets having an indentation in said inner face sufficient to receive at least the aperture-containing portion of said studs, said heat shield ring further comprising a plurality of channels extending from said outer perimeter through at least one of said transversely aligned apertures of said studs when said studs are received within said sockets; and a mechanical attaching means extending from said outer perimeter of said heat shield ring through at least one of said transversely aligned apertures to affix said heat shield ring to said annular end-face.

2. The heat shield burner nozzle of claim 1 wherein said mechanical attaching means is a plurality of rod-shaped bayonet wires corresponding to the number of said channels, said bayonet wires having a dimension sufficient so that when said nozzle lip is received within said heat shield ring and said studs are received within said corresponding sockets said bayonet wires are slideably engaged through said channels and through the aperture of said studs thereby attaching said heat shield ring to said annular end-face.

3. The heat shielded burner nozzle according to claim 1 wherein a plurality of said channels are located on a plane perpendicular to said longitudinal axis.

4. The heat shielded burner nozzle according to claim 1 wherein said plurality of studs are sufficiently located on said annular end-face to provide for contiguous positioning of the inner face of said heat shield ring thereto upon engagement of said attaching means.

5. The heat shielded burner nozzle according to claim 4 wherein said plurality of studs includes six pairs of studs protruding downwardly from said annular end-face along three axes on said plane, wherein two of said pairs lie on each axis on opposite sides of said nozzle discharge axis, wherein said heat shield ring includes sockets and channels corresponding thereto.

6. The heat shielded burner nozzle according to claim 1 wherein said inner perimeter has an angle corresponding to the incline of said nozzle lip.

7. The heat shielded burner nozzle according to claim 6 wherein said nozzle lip has a conical incline.

8. The heat shielded burner nozzle according to claim 1 wherein the thickness of said heat shield ring is substantially equivalent to the thickness of said nozzle lip.

9. The heat shielded burner nozzle according to claim 1 wherein said heat shield ring is formed from a material having a high melting point, a high coefficient of thermal expansion, a high fracture toughness, and a greater resistance to a high temperature combustion chamber environment, compared to the materials forming the remainder of said burner nozzle.

10. The heat shielded burner nozzle according to claim 9 wherein said heat shield ring is formed from a silicon nitride, a silicon carbide, a zirconia based ceramic, a molybdenum metal alloy, a tungsten metal alloy, or a tantalum metal alloy.

11. The heat shielded burner nozzle according to claim 1 wherein, when said heat shield ring is relatively tightly attached to said coolant end-face, said nozzle lip and said coolant end-face are shielded against an influx of a combustion product recirculation stream in the combustion chamber.

12. The heat shielded burner nozzle according to claim 2 wherein said rod shaped bayonet wire includes a grasping end, thereby providing an essentially L-shaped bayonet wire, and wherein the outer perimeter of said heat shield ring includes a notch to receive said grasping end within said heat shield ring.

13. The heat shielded burner nozzle according to claim 1 wherein said central channel is configured to deliver an oxidizer gas stream and said at least two annular channels includes an annular channel configured to deliver a slurried fuel stream, surrounded by another annular channel configured to deliver an oxidizer gas stream.

14. The heat shielded burner nozzle according to claim 1 wherein said annular end-face lies substantially perpendicular to said longitudinal axis.

15. A heat shielded burner nozzle for injecting a plurality of fluidized synthesis gas reaction materials into a high temperature combustion chamber, said heat shielded burner nozzle comprising:

an elongated outer shell having a longitudinal nozzle discharge axis and a plurality of elongated circumferentially reduced inner shells defining at least two annular channels surrounding a central channel, said shells having upstream and downstream ends defining upstream and downstream orifices transected by said longitudinal axis, said downstream ends of said shells forming a burner head face having an outer perimeter, said downstream end of said outer shell and said outer perimeter of said burner head face defining a nozzle lip having a top, an incline, and a thickness as measured along said longitudinal axis;

a coolant jacket enveloping said outer shell and defined by an annular end-face radially extending from the top of said nozzle lip to an outermost perimeter out of which longitudinally extends a cylindrical outer wall;

a heat shield ring having a thickness, an inner face and an outer face, and an inner perimeter and an outer perimeter, wherein said inner perimeter defines an opening sufficient to receive said nozzle lip; and a mechanical means of attaching said heat shield ring to said annular end-face when said nozzle lip is received within said heat shield ring opening so that said annular end-face and said mechanical attaching means are shielded from an influx of a corrosive combustion product recirculation stream in the combustion chamber by said heat shield ring.

16. The heat shielded burner nozzle according to claim 15 wherein the thickness of said heat shield ring is substantially equivalent to the thickness of said nozzle lip.

17. The heat shielded burner nozzle according to claim 15 wherein said heat shield ring is formed from a silicon nitride, a silicon carbide, a zirconia based ceramic, a molybdenum metal alloy, a tungsten metal alloy, or a tantalum metal alloy.

18. The heat shielded burner nozzle according to claim 15 wherein said annular end-face lies substantially perpendicular to said longitudinal axis.

19. The heat shielded burner nozzle according to claim 15 wherein said central channel is configured to deliver an oxidizer gas stream and said at least two annular channels includes an annular channel configured to deliver a slurried fuel stream, surrounded by another annular channel configured to deliver an oxidizer gas stream.

* * * * *